US011477869B1

(12) United States Patent
Wu et al.

(10) Patent No.: US 11,477,869 B1
(45) Date of Patent: Oct. 18, 2022

(54) LIGHT DEVICE CONTROL SYSTEM, LIGHT DEVICE CONTROLLER AND CONTROL METHOD THEREOF

(71) Applicant: LITE-ON TECHNOLOGY CORPORATION, Taipei (TW)

(72) Inventors: Wei-Ting Wu, Taipei (TW); Jhao-Tian Pan, Taipei (TW)

(73) Assignee: LEOTEK CORPORATION

( * ) Notice: Subject to any disclaimer, the term of this patent is extended or adjusted under 35 U.S.C. 154(b) by 0 days.

(21) Appl. No.: 17/501,866

(22) Filed: Oct. 14, 2021

Related U.S. Application Data

(60) Provisional application No. 63/177,450, filed on Apr. 21, 2021.

(30) Foreign Application Priority Data

Aug. 2, 2021 (TW) ..... 11012836.1

(51) Int. Cl.
*H05B 45/50* (2022.01)

(52) U.S. Cl.
CPC ..... *H05B 45/50* (2020.01)

(58) Field of Classification Search
None
See application file for complete search history.

(56) References Cited

U.S. PATENT DOCUMENTS

2005/0206529 A1* 9/2005 St.-Germain ..... H05B 47/20 340/815.45
2011/0288658 A1* 11/2011 Walters ..... H04L 67/025 700/12
2014/0028200 A1* 1/2014 Van Wagoner ..... H05B 47/18 315/307

FOREIGN PATENT DOCUMENTS

CN 104797066 A 7/2015
TW M463019 U 10/2013
TW M604378 U 11/2020

* cited by examiner

*Primary Examiner* — Anh Q Tran
(74) *Attorney, Agent, or Firm* — Innovation Counsel LLP

(57) ABSTRACT

The application provides a light device control system, a light device controller and a control method thereof. The light device controller includes: a detection circuit for detecting an input voltage; and a control unit coupled to the detection circuit, the control unit controlling the detection circuit to perform continuous detection during a predetermined interval, and the detection circuit sends a plurality of detection results due to continuous detection to the control unit, wherein whether a corresponding light device is failed is determined based on the plurality of detection results.

17 Claims, 4 Drawing Sheets

LIGHT DEVICE CONTROL SYSTEM, LIGHT DEVICE CONTROLLER AND CONTROL METHOD THEREOF

CROSS-REFERENCE TO RELATED ART

This application claims the benefit of U.S. provisional application Ser. No. 63/177,450, filed Apr. 21, 2021, and Taiwan application Serial No. 110128361, filed Aug. 2, 2021, the subject matters of which are incorporated herein by references.

TECHNICAL FIELD

The disclosure relates in general to a light device control system, a light device controller and a control method thereof, and more particularly to a light device control system, a light device controller and a control method thereof for determining whether an LED light device is failed by performing continuous detection during a predetermined time interval.

BACKGROUND

LED (light emitting diode) street light device or light device is more and more popular because LED has the following advantages: (1) the light source (LED) of the LED street light device is unidirectional, little scattering and thus high efficiency; (2) the LED street light device has low light attenuation and long lifetime; and (3) LED of the LED street light device is a low potential element and high safety.

For now, when the LED street light device is failed, the power supply is abnormal, the supply voltage is unstable or the LED street light device is stroke by lightning, the LED street light device may have flicker or abnormal brightness, which will negatively influence city appearance and traffic safety.

Intelligent LED street light controller detects input voltage or input current of the LED street light device and sends the LED street light device information to a management platform. However, detection on input voltage or input current of the LED street light device is single detection. When the system outputs the detection command or when the detection timing arrives, the detection device detects transient input voltage or input current of the LED street light device. FIG. 1 shows current timing diagram for detecting failed LED street light device in prior art. As shown in FIG. 1, at the measuring point T1, the current of the LED street light device is measured once. From FIG. 1, when the LED street light device flickers or is failed, the current of the LED street light device is time-varying. Thus, a single current measurement at one specified time point will not immediately reflect that the current of the LED street light device is continuously varied and thus, it is not able to identify that the LED street light device flickers or is failed on time. Therefore, the LED street light device management platform or the administrator will not identify that the LED street light device flickers or is failed on time.

SUMMARY

The disclosure is directed to a light device control system, a light device controller and a control method thereof. By recording electrical characteristic (the current value or the voltage value) during a continuous time interval, it is determined whether the LED street light device is failed or not.

By so, the problem of not on-time identifying that the LED street light device flickers or is failed is solved.

According to one embodiment, provided is a light device controller including: a detection circuit for detecting an input voltage; and a control unit coupled to the detection circuit, the control unit controlling the detection circuit to perform continuous detection during a predetermined interval, and the detection circuit sending a plurality of detection results due to continuous detection to the control unit, wherein whether a corresponding light device is failed is determined based on the plurality of detection results.

According to another embodiment, provided is a control method for a light device, the control method including: detecting an input voltage; performing continuous detection during a predetermined interval to generate a plurality of detection results; and determining whether a corresponding light device is failed based on the plurality of detection results.

According to an alternative embodiment, provided is a light device control system including: a light device controller for detecting an input voltage and performing continuous detection during a predetermined interval to generate a plurality of detection results; and a management platform coupled to the light device controller, wherein either the light device controller or the management platform determines whether a corresponding light device is failed based on the plurality of detection results.

Figure 1:
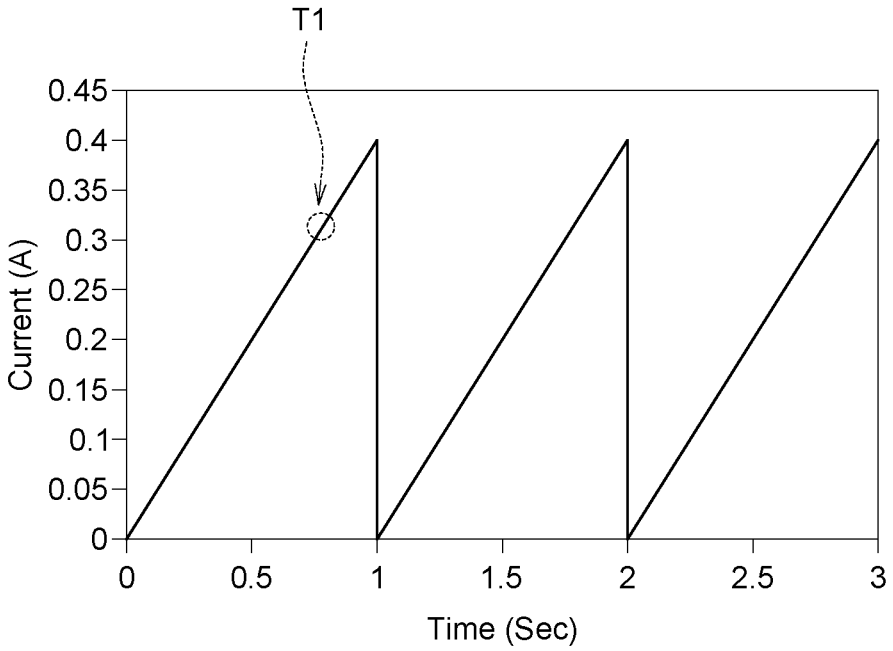
FIG. 1 (PRIOR ART)
FIG. 1 shows current timing diagram for detecting failed LED street light device in prior art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DESCRIPTION OF THE EMBODIMENTS

Technical terms of the disclosure are based on general definition in the technical field of the disclosure. If the disclosure describes or explains one or some terms, definition of the terms is based on the description or explanation of the disclosure. Each of the disclosed embodiments has one or more technical features. In possible implementation, one skilled person in the art would selectively implement part or all technical features of any embodiment of the disclosure or selectively combine part or all technical features of the embodiments of the disclosure.

Figure 2:
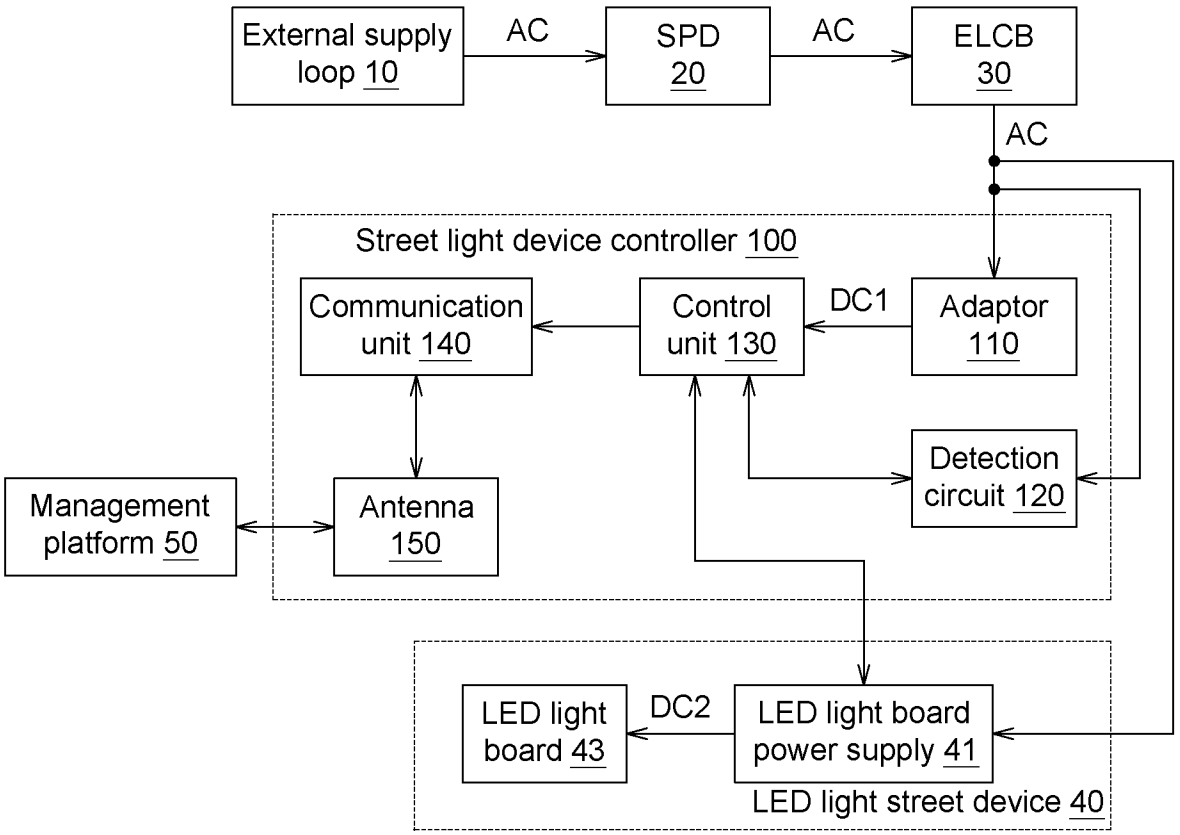
FIG. 2 shows a functional block diagram of a street light device controller according to one embodiment of the application.

FIG. 2 shows a functional block diagram of a street light device controller according to one embodiment of the application. As shown in FIG. 2, the street light device controller 100 according to one embodiment of the application includes an adaptor 110, a detection circuit 120, a control unit 130, a communication unit 140 and an antenna 150. In one embodiment of the application, the street light device controller 100 is independent from an LED light street device 40. But in another embodiment of the application, the street light device controller 100 may be integrated into the LED light street device 40, which is also within the spirit of the application. That is, the street light device controller 100 is corresponding to the LED light street device 40; and the LED light street device 40 may be also referred as a corresponding to light device.

An external supply loop 10 is for providing AC voltage (for example but not limited by, 220V) to a surge protective device (SPD) 20. The SPD 20 is for removing ripples of the AC voltage to protect subsequent circuits from being damaged by the voltage ripples. The ripple-removed AC voltage is sent from the SPD 20 to an Earth Leakage Circuit Breaker (ELCB) 30. The ELCB 30 provides the AC voltage to the street light device controller 100 and the LED light street device 40.

The adaptor 110 of the street light device controller 100 transforms the AC voltage from the ELCB 30 into the DC voltage DC1 required by the street light device controller 100; and an LED light board power supply 41 of the LED light street device 40 transforms the AC voltage from the ELCB 30 into the DC voltage DC2 required by the LED light street device 40. The DC voltage DC1 required by the street light device controller 100 is a first voltage value (for example but not limited by, 12V); and the DC voltage DC2 required by the LED light street device 40 is a second voltage value (for example but not limited by, 48V or higher).

The adaptor 110 is coupled to the ELCB 30 for transforming the AC voltage into the DC voltage DC1 and for providing to the control unit 130.

The LED light board power supply 41 is coupled to the ELCB 30 for transforming the AC voltage into the DC voltage DC2 and for providing to the LED light board 43. By so, a plurality LEDs of the LED light board 43 emit light.

The detection circuit 120 is coupled to the ELCB 30. In response to detection commands from the control unit 130, the detection circuit 120 monitors electrical characteristics (for example but not limited by, a voltage value or a current value) of the AC voltage (also referred as an input voltage) from the ELCB 30 and sends the detected electrical characteristics (also referred as a detection result) to the control unit 130.

The control unit 130 is coupled to the adaptor 110 and the detection circuit 120. The control unit 130 provides detection commands to the detection circuit 120 and receives the electrical characteristics from the detection circuit 120. The control unit 130 controls the detection circuit 120 to perform continuous detection during a predetermined time interval. For example, during a time interval, the control unit 130 provides continuous detection commands to the detection circuit 120 and thus, the detection circuit 120 continuously detects the electrical characteristics during the time interval. Then, the detection circuit 120 sends a plurality of detection results to the control unit 130.

The communication unit 140 is coupled to the control unit 130. Uplink and downlink information are received and transmitted between the communication unit 140 and the control unit 130. Further, the communication unit 140 receives the electrical characteristics from the control unit 130 and sends the received electrical characteristics to the antenna 150.

The antenna 150 is coupled to the communication unit 140. Uplink and downlink information are received and transmitted between the communication unit 140 and the antenna 150. Further, the antenna 150 receives the electrical characteristics from the communication unit 140 and sends to the management platform 50. Further, uplink information and downlink commands are received and transmitted between the management platform 50 and the antenna 150.

In one embodiment of the application, the control unit 130 controls the detection circuit 120 to continuously detect during a predetermined time interval. Further, based on a user-defined sampling time interval and a user-defined sampling frequency, the control unit 130 triggers a plurality of (continuous) detection commands to the detection circuit 120 and thus the detection circuit 120 performs continuous detection based on the user-defined sampling time interval and the user-defined sampling frequency.

Another embodiment of the application discloses a light device control system includes the light device controller 100 and the management platform 50.

Figure 3:
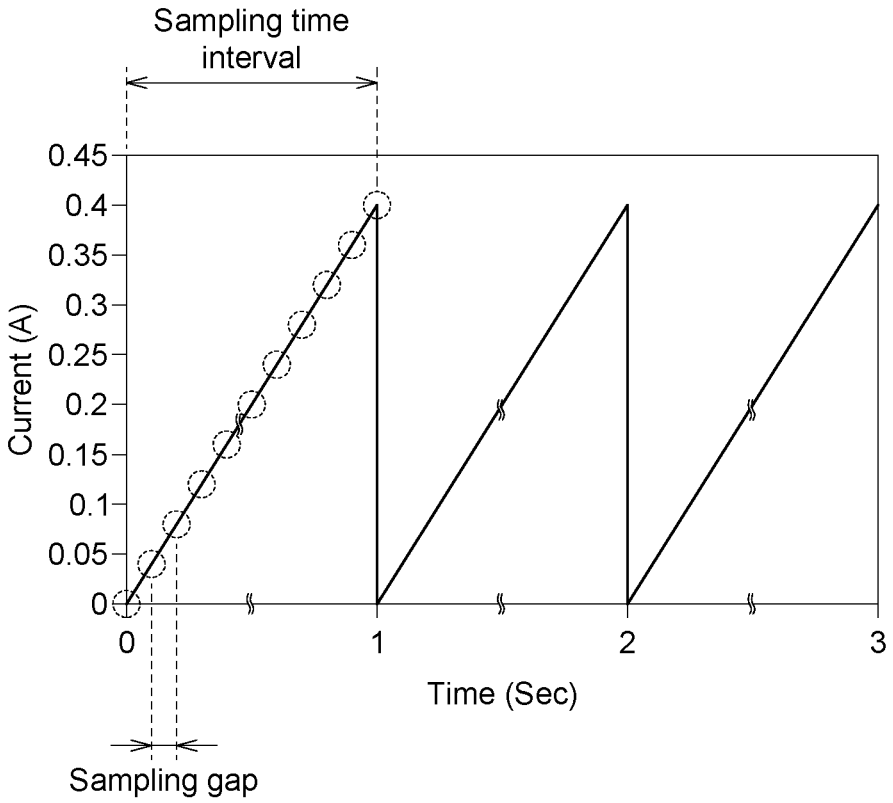
FIG. 3 shows continuous current detection according to one embodiment of the application.

FIG. 3 shows continuous current detection according to one embodiment of the application. As shown in FIG. 3, the current of the AC voltage is continuously detected based on the user-defined sampling time interval and the user-defined sampling frequency. For example but not limited by, in one embodiment of the application, the user-defined sampling time interval is between 1 ms~50 ms, i.e. there are at least 20 samples per second. Or, in still another embodiment of the application, the sampling interval is ⅙ second (i.e. detecting six times per second) to generate six current sampling values per second. These two sampling methods are within the spirit of the application.

In one embodiment of the application, the control unit 130 or the management platform 50 determines whether the LED street light device 40 is failed or not based on the electrical characteristics. Here, "continuous measurement" or "continuous detection" refers to perform a plurality of measurements or detection during a time interval (for example but not limited by, one second) to identify current variation and further to determine whether the LED street light device 40 is failed or not.

Example One: The Control Unit 130 Determines Whether the LED Street Light Device 40 is Failed or not Based on the Electrical Characteristics In the example one, the control unit 130 determines the sampling frequency and the sampling interval. After the control unit 130 receives the detected data (i.e. the electrical characteristics), the control unit 130 analyzes the measured data to determine whether the LED street light device 40 is failed or not. Data analysis is described later. When the control unit 130 determines that the LED street light device 40 is failed, the control unit 130 sends a device failure message or a device failure code of the failed LED street light device 40 via the communication unit 140 and the antenna 150 to the management platform 50, for informing the management platform 50 that the LED street light device 40 is failed.

In example one, the control unit 130 determines whether the LED street light device 40 is failed or not, and the control unit 130 have high computation requirement and high power consumption, but the data rate between the controller 100 and the management platform 50 is smaller.

Example Two: The Management Platform 50 Determines Whether the LED Street Light Device 40 is Failed or not Based on the Electrical Characteristics In the example two, the control unit 130 determines the sampling frequency and the sampling interval. After the controller 100 receives the detected data (i.e. the electrical characteristics), the controller 100 sends the measured data to the management platform 50, and the management platform 50 determines whether the LED street light device 40 is failed or not by analyzing the measurement data. Data analysis is described later.

In example two, the control unit 130 uploads a plurality of current detection values or voltage detection values to the management platform 50, and thus the data rate between the controller 100 and the management platform 50 is higher. However, the control unit 130 is not required to determine whether the LED street light device 40 is failed not, and the control unit 130 has lower computation requirement and low power consumption.

Figure 4:
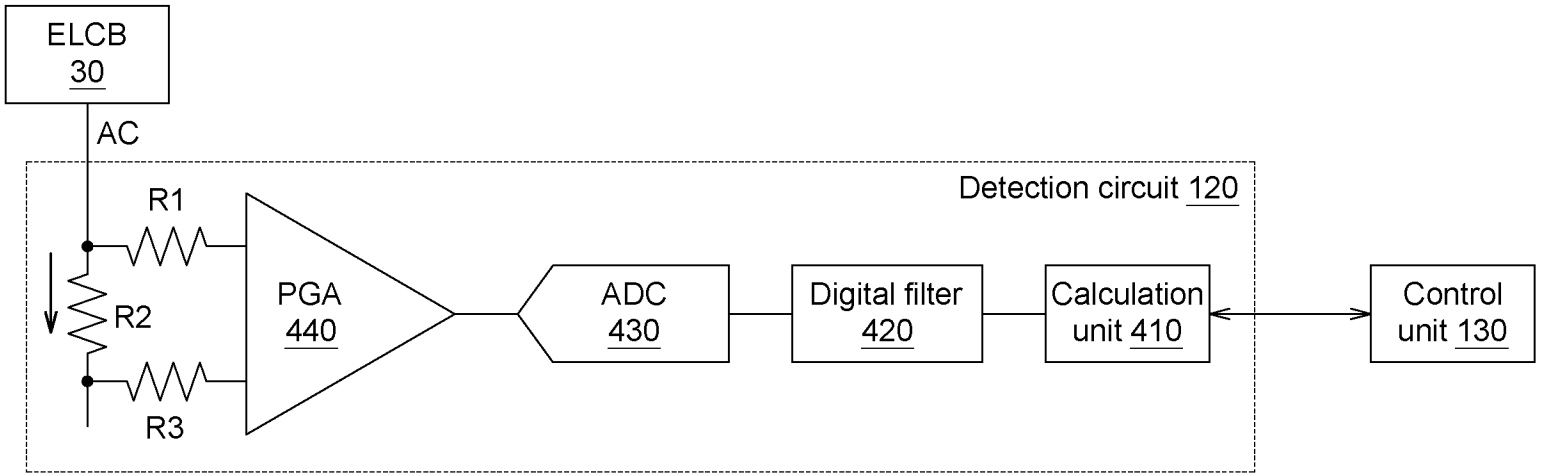
FIG. 4 shows a functional block of the detection circuit according to one embodiment of the application.

FIG. 4 shows a functional block of the detection circuit 120 according to one embodiment of the application. As shown in FIG. 4, the detection circuit 120 includes a calculation unit 410, a digital filter 420, an ADC (analog-to-digital converter) 430 and a programmable gain amplifier (PGA) 440. Further, the detection circuit 120 further includes resistors R1~R3.

When the control unit 130 sends the (continuous) detection commands to the calculation unit 410 via a Universal Asynchronous Receiver/Transmitter (UART) interface, the calculation unit 410 sends the voltage detection results or the current detection results via a Digital output to the control unit 130 based on the required sampling frequency and the sampling interval.

In details, the current or the voltage of the AC voltage from the ELCB 30 is amplified by the PGA 440. The output from the PGA 440 is converted into digital signals via the ADC 430. Digital signals outputted from the ADC 430 are filtered by the digital filter 420. The output of the digital filter 420 is the measured electrical characteristics. The output of the digital filter 420 is sent to the calculation unit 410 and outputs to the control unit 130 via the calculation unit 410.

Now, how to determine whether the LED street light device 40 is failed or not based on the detected voltages or currents in one embodiment of the application is described.

In one embodiment of the application, based on the received measurement data, the control unit 130 or the management platform 50 collects the measurement data and calculates a current average value (Ia) and a current standard deviation value (Iσ) during the sampling interval. During the operation status period of the LED street light device 40, if $|I\sigma| \geq K*|Ia|$, then the control unit 130 or the management platform 50 determines that the current status of the LED street light device 40 is not stable (i.e. flickered or unstable brightness), wherein K is a parameter, for example but not limited by, K=0.05.

Data calculation and determination may be performed by the control unit 130 or the management platform 50. In the case that data calculation is performed by the control unit 130, after the control unit 130 completes data calculation, the control unit 130 sends the device failure message or the device failure code to the management platform 50, and the administrator monitors this data.

Table 1 shows data statistics of the normal LED street light device and the faded LED street light device during a detection interval. As for the normal LED street light device, a ratio of the voltage (or the current) standard deviation value to the voltage (or the current) average value is within 5%. However, as for the failed LED street light device, the ratio of the voltage (or the current) standard deviation value to the voltage (or the current) average value is above 5%. The voltage (or the current) standard deviation value and the voltage (or the current) average value are also referred as the electrical characteristics standard deviation value and the electrical characteristics average value, respectively.

TABLE 1

| data statistics | normal LED street light device | faded LED street light device |
|---|---|---|
| Number of the LED street light device | 5113 | 36 |
| voltage average value (V) | 229.1 | 248.3 |
| voltage standard deviation value (V) | 4.7 | 14.3 |
| ratio of the voltage standard deviation value to the voltage average value | 2.1% | 5.8% |
| the current average value (A) | 0.414 | 0.353 |
| the current standard deviation value (A) | 0.013 | 0.054 |
| ratio of the current standard deviation value to the current average value | 3.1% | 15.3% |

Table 2 shows data statistics of continuous measurements of the voltage and the current of a single LED street light device in a lab, wherein the measurement interval is five minutes and the measuring interval is 0.1 second. The ratio of the current standard deviation value to the current average value is about 30%. This shows that whether the LED street light device is failed or not is detected by continuous measurements during a predetermined time interval.

TABLE 2

| data statistics | flickered LED street light device |
|---|---|
| voltage average value (V) | 110.2 |
| voltage standard deviation value (V) | 0.9 |
| ratio of the voltage standard deviation value to the voltage average value | 0.8% |
| the current average value (A) | 0.687 |
| the current standard deviation value (A) | 0.211 |
| ratio of the current standard deviation value to the current average value | 30.7% |

In the street light device controller, the controlling method and the control system according to one embodiment of the application, by recording variation of electrical characteristics (for example, the current or the voltage) during a time interval, whether the LED street light device is failed or flickered is determined. By so, one embodiment of the application prevents the prior problem that the LED street light device flickers or is failed is not identified on time.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A light device controller including:

a detection circuit for detecting an input voltage; and a control unit coupled to the detection circuit, the control unit controlling the detection circuit to perform continuous detection during a predetermined interval, and the detection circuit sending a plurality of detection results due to continuous detection to the control unit, wherein whether a corresponding light device is failed is determined based on the plurality of detection results, and wherein the control unit sends a plurality of detection commands to the detection circuit for performing continuous detection to generate the plurality of detection results based on a user-defined sample time interval and a user-defined sample frequency.

2. The light device controller according to claim 1, wherein the control unit determines whether the corresponding light device is failed based on the plurality of detection results.

3. The light device controller according to claim 2, wherein when the control unit determines that the corresponding light device is failed, the control unit outputs a device failure message or a device failure code of the corresponding light device to a management platform.

4. The light device controller according to claim 1, wherein the light device controller uploads the plurality of detection results to a management platform; and the management platform determines whether the corresponding light device is failed based on the plurality of detection results.

5. The light device controller according to claim 1, wherein the user-defined sampling time interval is between 1 ms~50 ms.

6. The light device controller according to claim 1, wherein whether the corresponding light device is failed is determined based on an electrical characteristic standard deviation and an electrical characteristic average value of the input voltage.

7. A control method for a light device, the control method including:

detecting an input voltage;

performing continuous detection during a predetermined interval to generate a plurality of detection results; and determining whether a corresponding light device is failed based on the plurality of detection results, wherein continuous detection is performed to generate the plurality of detection results based on a user-defined sample time interval and a user-defined sample frequency.

8. The control method for the light device according to claim 7, wherein a control unit of a light device controller determines whether the corresponding light device is failed based on the plurality of detection results.

9. The control method for the light device according to claim 8, wherein when the control unit determines that the corresponding light device is failed, the control unit outputs a device failure message or a device failure code of the corresponding light device to a management platform.

10. The control method for the light device according to claim 7, wherein the plurality of detection results are sent to a management platform; and the management platform determines whether the corresponding light device is failed based on the plurality of detection results.

11. The control method for the light device controller according to claim 7, wherein the user-defined sampling time interval is between 1 ms~50 ms.

12. The control method for the light device according to claim 7, wherein whether the corresponding light device is failed is determined based on an electrical characteristic standard deviation and an electrical characteristic average value of the input voltage.

13. A light device control system including:

a light device controller for detecting an input voltage and performing continuous detection during a predetermined interval to generate a plurality of detection results; and a management platform coupled to the light device controller, wherein either the light device controller or the management platform determines whether a corresponding light device is failed based on the plurality of detection results, wherein the light device controller includes: a detection circuit for detecting the input voltage; and a control unit coupled to the detection circuit for controlling the detection circuit to perform continuous detection during the predetermined interval, wherein the detection circuit sends the plurality of detection results due to continuous detection to the control unit, and wherein the control unit sends a plurality of detection commands to the detection circuit for performing continuous detection to generate the plurality of detection results based on a user-defined sample time interval and a user-defined sample frequency.

14. The light device control system according to claim 13, wherein when the light device controller determines that the corresponding light device is failed, the light device controller outputs a device failure message or a device failure code of the corresponding light device to the management platform.

15. The light device control system according to claim 13, wherein the light device controller sends the plurality of detection results to the management platform; and the management platform determines whether the corresponding light device is failed based on the plurality of detection results.

16. The light device control system according to claim 13, wherein the user-defined sampling time interval is between 1 ms~50 ms.

17. The light device control system according to claim 13, wherein either the light device controller or the management platform determines whether the corresponding light device is failed based on an electrical characteristic standard deviation and an electrical characteristic average value of the input voltage.

* * * * *